United States Patent [19]

Hjalmarsson

[11] Patent Number: 4,909,163

[45] Date of Patent: Mar. 20, 1990

[54] METHOD AND A DEVICE FOR COOLING ASHES IN A PFBC POWER PLANT

[75] Inventor: Lennart Hjalmarsson, Finspong, Sweden

[73] Assignee: ABB Stal AB, Finspong, Sweden

[21] Appl. No.: 289,180

[22] Filed: Dec. 23, 1988

[30] Foreign Application Priority Data

Dec. 23, 1987 [SE] Sweden ..... 8705151

[51] Int. Cl.[4] ..... F02C 3/26

[52] U.S. Cl. ..... 110/266; 110/347; 60/39.464

[58] Field of Search ..... 60/39.02, 39.12, 39.464; 110/263, 266, 347; 122/4 D; 431/7, 170

[56] References Cited

U.S. PATENT DOCUMENTS 4,471,723 9/1984 Chrysostome ..... 122/4 D
4,474,119 10/1984 Jones ..... 110/263
4,590,868 5/1986 Ishihara ..... 110/347
4,736,711 4/1988 Marlair et al. ..... 122/4 D
4,804,405 2/1989 Jonsson .

FOREIGN PATENT DOCUMENTS 0063173 10/1982 European Pat. Off. .
2805244 8/1979 Fed. Rep. of Germany .
2076498 10/1971 France .
2307584 11/1976 France .

*Primary Examiner*—Louis J. Casaregola
*Attorney, Agent, or Firm*—Pollock, Vande Sande & Priddy

[57] ABSTRACT

A method of cooling ashes and bed material when discharging the material via an ash chamber (20) in or near a combustor burning a fuel in a bed (28) of particulate material. Cooling gas is introduced into the ash chamber (20) via a gas distributor (70), is allowed to pass through a material layer (21), is discharged via a collecting device (76) and is circulated through a cooling circuit (69) with a cooler (82) by a compressor or fan (88). The invention also relates to a power plant in which the method is utilized.

6 Claims, 2 Drawing Sheets

METHOD AND A DEVICE FOR COOLING ASHES IN A PFBC POWER PLANT

TECHNICAL FIELD

The invention relates to a method and a device for cooling ashes and bed material in a discharged device in a combustion chamber burning a fuel in a fluidizable, particulate material. It is primarily intended for use in a plant with a combustor with an air distributing bed bottom having openings which allow the bed and the formed ashes to drop down to a space below the bottom for discharge of the material.

BACKGROUND ART

It is necessary to cool the material discharged from the combustor to a temperature which permits a good manageability in the discharge system. In plants with a combustor with an air distributing bottom with openings allowing material from the combustion space of the combustor to pass to an ash chamber below this bottom, it is known to supply cooling air to the ash chamber, which cooling air is allowed to rise up through the material and the bottom to the combustion space. In this space, the cooling air is utilized for the combustion. A plant of this kind is disclosed in U.S. patent application Ser. No. 065,475 (Jonsson). The air flow necessary for cooling of material is so large that it is difficult to avoid local fluidization in the ash chamber or in the openings in the air distributing bottom. Such fluidization may prevent the material transport. Cooling by air also involves a risk of sintering, especially if the bed material should contain unburnt fuel.

It is also known to cool the material by means of tubes, placed in the ash chamber, which are traversed by combustion air or water. However, it has been found to be difficult to obtain a sufficient cooling surface within the available space. Pipe installation in the ash chamber is undesirable also from the point of view of service.

SUMMARY OF THE INVENTION

According to the invention ashes and bed material in the ash chamber of a combustor are cooled by gas on their way through this chamber to a discharge device, the gas being circulated through a layer of material in the ash chamber and a cooling system which cools the gas. Possible oxygen in the gas burns fuel residues passing down into the ash chamber. In practice, therefore, the circulating gas can become oxygen-free or very oxygen-poor. The material in the ash chamber is particulate and the contact surface between the material particles and the gas is very large. The interchange of heat becomes very effective. The necessary thickness of the layer through which the cooling gas needs to pass is small. The cooling device is simple, requires no or little service and simplifies the combustor. The problem with undesired, often local fluidization of the material in the ash chamber, which disturbs the flow and the cooling, is eliminated. The risk of sintering is also eliminated.

The gas cooler can be utilized, for example, for the heating of feed water to tubes in the combustor which cool the fluidized bed in the combustor and generate steam for a steam turbine. The gas cooler may contain a bed, fluidizable by the cooling gas, which provides great specific heat transfer to preheater tubes for the feed water.

BRIEF DESCRIPTION OF THE DRAWING

The invention will be described in greater detail with reference to the accompanying drawing, wherein FIG. 1 schematically shows a PFBC power plant with one embodiment of the invention.

DESCRIPTION OF THE PREFERRED EMBODIMENT

Figure 1:
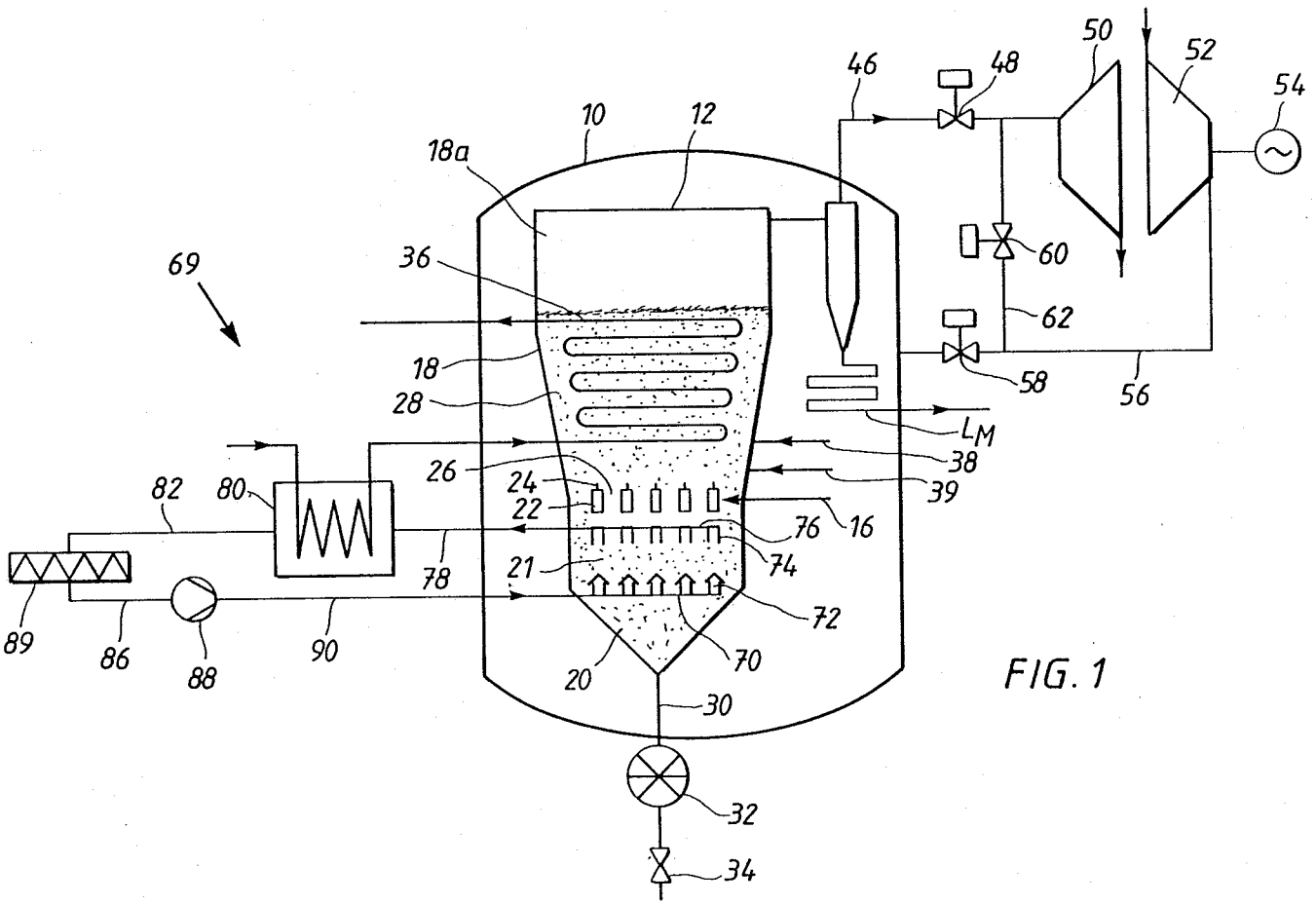

In FIG. 1, 10 designates a pressure vessel, 12 a combustor and 14 a gas cleaner of cyclone type enclosed within the pressure vessel 10. Only one cyclone 14 is shown, but in reality the cleaning plant comprises a plurality of parallel groups of series-connected cyclones. The combustor 12 is divided by an air-distributing bottom 16 into an upper combustion space 18, the uppermost part of which forms a freeboard 18a, and a lower ash chamber 20. The bottom 16 consists of elongated air distribution chambers 22 with air nozzles 24. Gaps 26 are provided between the chambers 22. The combustion space 18 of the combustor 12 contains a fluidized bed 28 of particulate material. Consumed bed material and formed ashes may pass from the combustion space 18 to the ash chamber 20 via the gaps 26 and are removed via the conduit 30 with the material sluice 32 and the valve 34. The combustion space 18 comprises tubes 36 which cool the bed 28 and generate steam to a steam turbine (not shown). Fuel and fresh bed material are supplied to the bed 28 of the combustor 12 via the conduits 38 and 40, respectively, from storages (not shown) for fuel and bed material.

Combustion gases generated in the bed 28 are collected in the freeboard 18a and are led from there via the conduit 42 to the cyclone 14. Separated dust is removed via a pressure reducing discharge device 44. Cleaned gas is conducted in the conduit 46 with the cut-off valve 48 to the turbine 50. Compressed combustion air is conducted in the conduit 56 with the cut-off valve 58 to the space 59 between the pressure vessel 10 and the combustion 12. Air from here is distributed to the nozzles 24 via the air distribution chambers 22, fluidizes the bed material and burns the fuel in the bed 28.

In the event of an operational disturbance involving a gas turbine trip, the turbine 50 and the compressor 52 are isolated from the combustor 12 and the space 59, respectively, in the pressure vessel 10 by the valves 48 and 58 being shut. At the same time, the valve 60 in the conduit 62 is opened. In case of a lengthy operational disturbance and a shutdown of the plant, the pressure is reduced to the atmospheric level and, in many cases, the combustion space 18 is emptied via the ash chamber 20.

Both during normal operation and in case of a shutdown, ashes and bed material are cooled completely or partially, when being discharge from the ash chamber 20, by gas circulating through a layer 21 of material in the ash chamber 20 and a cooling system 69.

In the embodiment according to FIG. 1, the lower part of the ash chamber 10 comprises a tube system 70 with nozzles 72 for uniform distribution of cooling gas over the cross-section of the space 20. Above this downwardly open collecting channels 74 for the cooling gas are provided, which are connected to one or more collecting tubes 76. These tubes are connected, via a conduit 78, to the heat exchanger 80 of the cooling circuit, which heat exchanger 80 forms a preheater for feed water to the tubes 26. From the heat exchanger 80 the cooling gas is returned to the tube system 70 with the nozzles 72 via the conduit 82, the cleaner 84, the conduit 86, the compressor or fan 88, and the conduit 90. In operation of the plant, the working pressure is about 12 bar. The necessary driving pressure for circulating gas in the cooling circuit may be of the order of magnitude of 0.5 bar. Upon cooling the combustor 12 when emptying it in case of a shutdown, the pressure is equal to the atmospheric pressure. A suitable distance between the tube system 70 with the nozzles 72 and the collecting channels 74 is of the order of magnitude of 200 mm.

Figure 2:
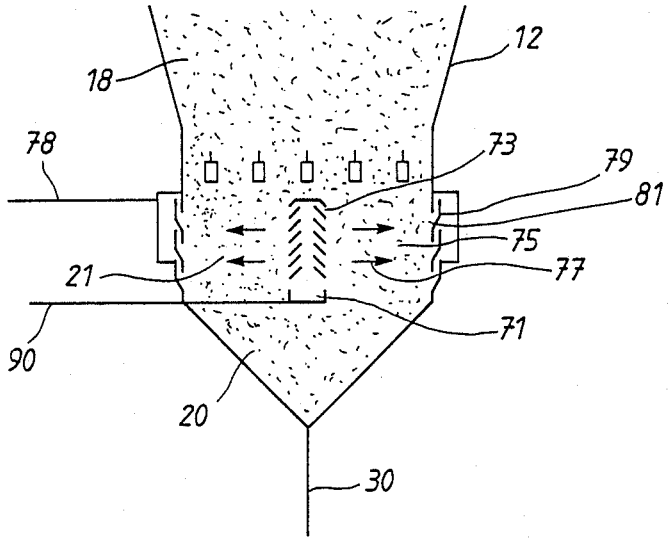
FIG. 2 shows the ash chamber with an alternative embodiment of the invention.

In the embodiment according to FIG. 2, there is a central, vertical cooling gas distributor 71 with slots 73 for distribution of the cooling gas to the ash layer 75. The cooling gas passes horizontally through the layer 73, as shown by the arrows 77, and is collected in the channels 79, which communicate with the ash chamber 21 through slots 81.

I claim:

1. A method of cooling ashes and bed material when discharging the ashes and the bed material from a combustor (12) with combustion in a fluidized bed (28) of particulate material with an ash chamber (20) in or near the combustor (12), characterized in that the material, when passing through the ash chamber (20), is cooled by a circulating gas which is introduced into the ash chamber (20) in such a way that the gas will pass through a substantially horizontal material layer (21), the heated gas being cooled in a heat exchanger (80) and being returned to the ash chamber (20).

2. A method according to claim 1, characterized in that the cooling gas is introduced into the ash chamber (20) via a gas distributon (70) at one level, passes up through the material layer (21), is collected in a collecting device (76) at another higher level, passes through a heat exchanger (80) and is returned to the gas distributor (70) of the ash chamber (20).

3. A method according to claim 1, characterized in that the cooling gas is introduced into the ash chamber (20) via a gas distributor (71), passes substantially horizontally through the material layer (21), is collected in a collecting device (79), passes through a heat exchanger (80) and is returned to the gas distributor (71) of the ash chamber (20).

4. A power plant burning a fuel in a fluidized bed (28) of particulate material, comprising a combustor (12) with a combustion space (18), a bottom (16) in the lower part of the combustor (12) with nozzles (24) for supply of combustion air to the combustion space (18) for fludization of a bed (28) and combustion of fuel supplied to the bed (28), an ash chamber (2) below the bottom (16) and means (32) for discharge of material from the ash chamber (20), openings in said bottom (16) through which material is able to pass from the combustion space (18) to the ash chamber (20), characterized in that it comprises a device (70, 71) for distribution of gas to a substantially horizontal material layer (21), a device (76, 79) for collection of gas which has passed through this material layer (21), a heat exchanger (80) for cooling of the gas, and a compressor or fan (88) which circulates the gas through the material layer (21) and the heat exchanger (80).

5. A power plant according to claim 4, characterized in that it comprises a substantially horizontal device (70) at a first level for distribution of cooling gas over the cross-section of the ash chamber (20), a device (76) at a higher level for collection of cooling gas, a cooling circuit, connected to the distribution device (70) and the collecting device (76), with a heat exchanger (80) and a compressor or fan (88) for circulation and cooling of the cooling gas.

6. A power plant according to claim 4, characterized in that it comprises a substantially vertical device (71) for distribution of cooling gas to the horizontal material layer (21), a collecting device (79), arranged around or opposite to the distribution device (71), for gas which has passed right across the material layer (21), and a cooling circuit, connected to the distribution device (71) and the collecting device (79), with a heat exchanger (80) and a compressor or fan (88) for circulation and cooling of the cooling gas.

* * * * *